US006116600A

United States Patent [19]

Aryan

[11] Patent Number: 6,116,600

[45] Date of Patent: Sep. 12, 2000

[54] SLIDABLE BLOCK PUZZLE

[76] Inventor: Labib A. Aryan, 26525 Gading Rd., Apt #2, Hayward, Calif. 94544

[21] Appl. No.: 09/316,107

[22] Filed: May 24, 1999

[51] Int. Cl.[7] ..... A63F 9/08

[52] U.S. Cl. ..... 273/153 S; 273/156

[58] Field of Search ..... 273/153 R, 156, 273/157 R, 153 S

[56] References Cited

U.S. PATENT DOCUMENTS 1,017,752 2/1912 Hardy .
4,546,979 10/1985 Knott .
5,490,675 2/1996 Persidsky et al. .
5,725,213 3/1998 Kuczynski .

FOREIGN PATENT DOCUMENTS 567223 5/1958 Belgium .
741696 6/1965 Canada .
381813 10/1932 United Kingdom .

*Primary Examiner*—William M. Pierce
*Attorney, Agent, or Firm*—Linval B. Castle

[57] ABSTRACT

A slidable block puzzle game played by maneuvering rectangular blocks in a smooth surfaced box with low walls is hinged to a lid of the same size that contains partitions that enclose each of the rectangular blocks in their initial game-starting position when the lid is closed.

4 Claims, 3 Drawing Sheets

Fig. 2
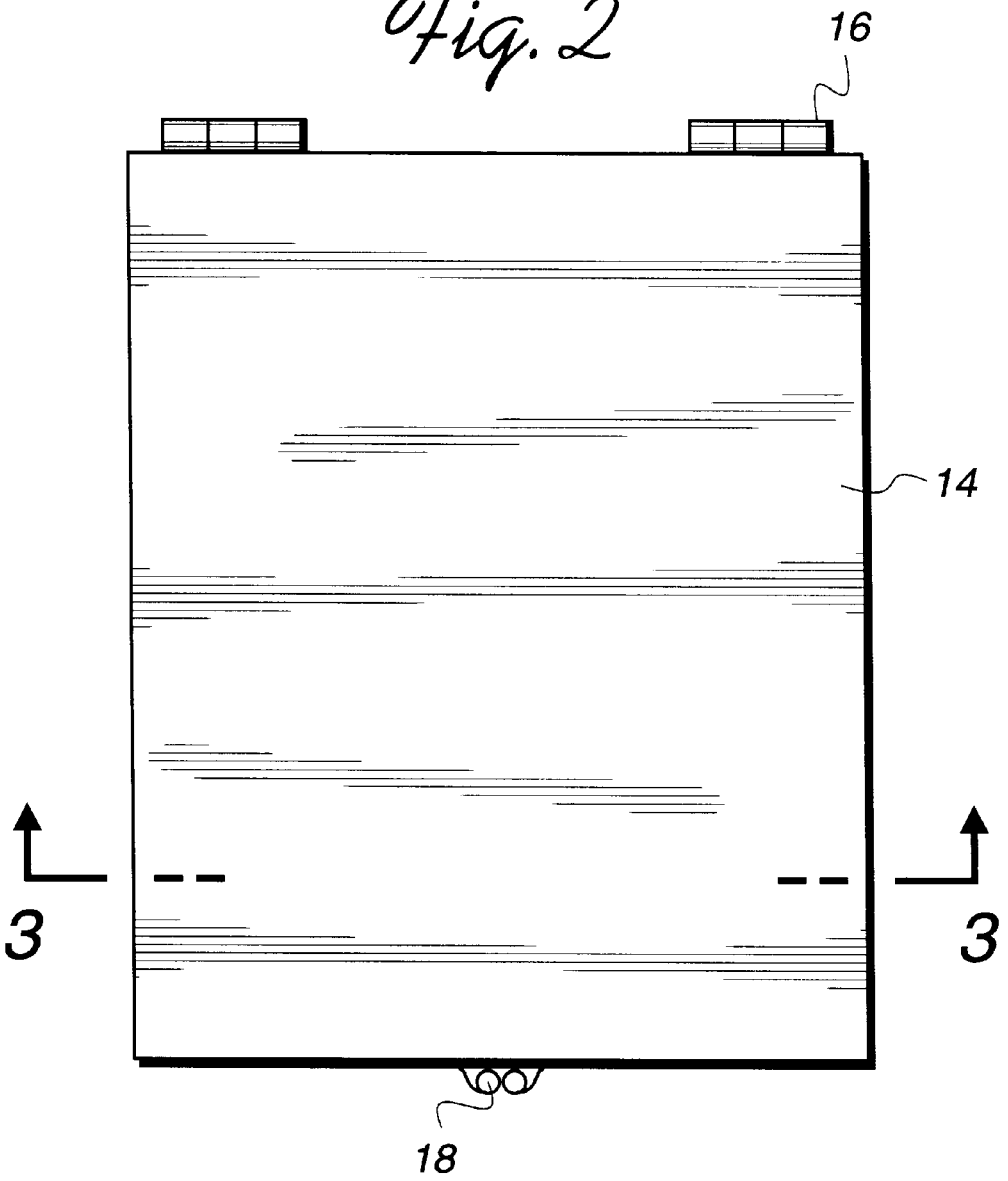
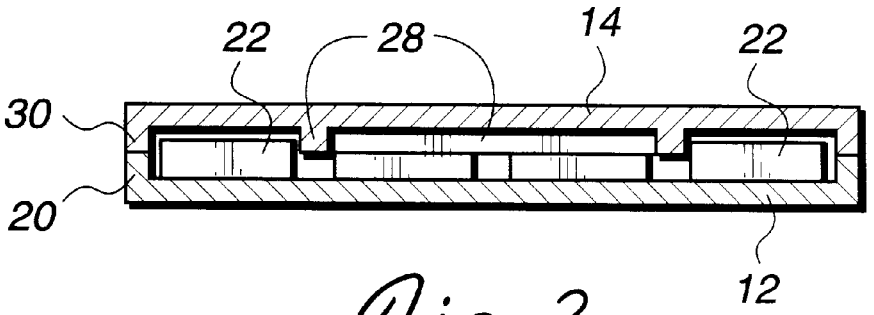
Fig. 3

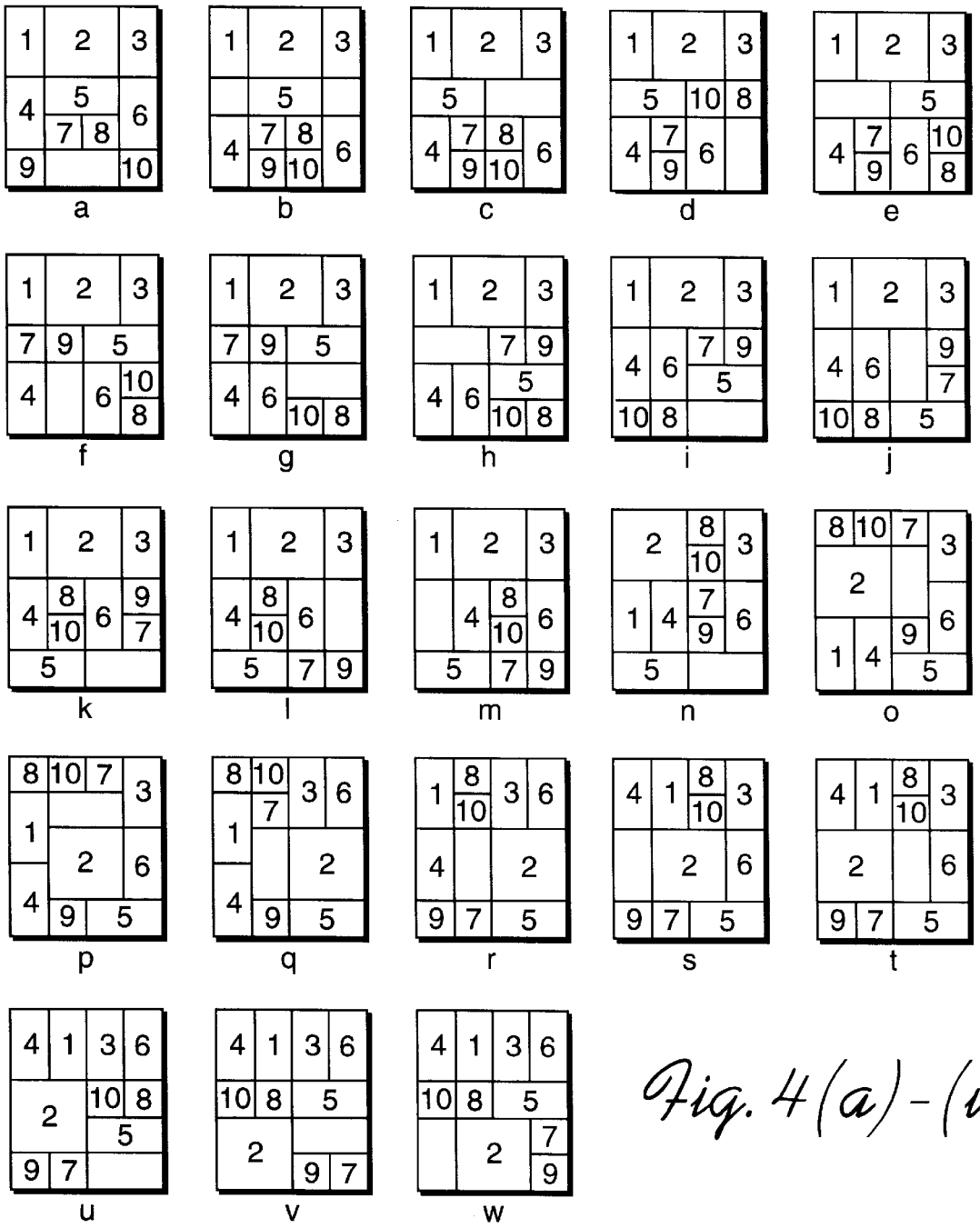
Fig. 4(a)-(w)

SLIDABLE BLOCK PUZZLE

This invention relates to slidable block puzzles wherein a plurality of blocks of different sizes confined within a frame may be rectilinearly moved into vacant zones, the object being to relocate a large object block from an initial position to a specific target position.

BACKGROUND OF THE INVENTION

Sliding block puzzles are very old and even sliding block puzzles identical to the present puzzle are described in the August 1966 Canadian Patent 741696. That patent shows a puzzle with one large square object block, five rectangular blocks that are half the size of the target block, and four small square blocks that are one half the size of the rectangular blocks. All blocks are confined within a low-walled board that has inside dimensions equal to four small squares wide by five small squares in length. There is one empty space equal in size to a rectangular block so that various blocks may be moved on the board by moving into a vacant space. The large square object block is initially centered at one end of the board and the object is to maneuver it to the center of the opposite end where it may be removed through a fitted slot in the wall.

The same game with the same sliding blocks it described in 1990 U.S. Pat. No. 4,927,150. But here all blocks except the large square object block are keyed into slots in the board floor and are not removable. However, breaks in the walls of the board enable the object block to be removed from its target position and reinserted into its initial position at the opposite end of the board.

The slidable block puzzle to be described is played in a hinged square box having a cover or lid and a smooth playing board, both lid and playing board with solid low walls. The interior surface of the lid is partitioned to accommodate each block in its initial playing position. The space between the interior surfaces of the lid and the playing board is very little more than the thickness of the blocks so that when the lid is closed with the blocks within their partitions, the blocks remain captured in the partitions and there is a minimum of rattling of the blocks. When inverted and the lid is opened the blocks are in their initial position on the smooth surface of he playing board for maneuvering the large square object block to its target position in the center of the opposite end.

DESCRIPTION OF THE DRAWING

In the drawings that illustrate the preferred embodiment of the invention:

FIG. 2 is a plan view of the closed box;

FIG. 3 is a sectional edge view taken along the lines 3—3 of FIG. 2; and FIG. 4(*a*) through FIG. 4(*w*) illustrate the block moves for one method of solving the sliding block puzzle.

DESCRIPTION OF THE PREFERRED EMBODIMENT

Figure 1:
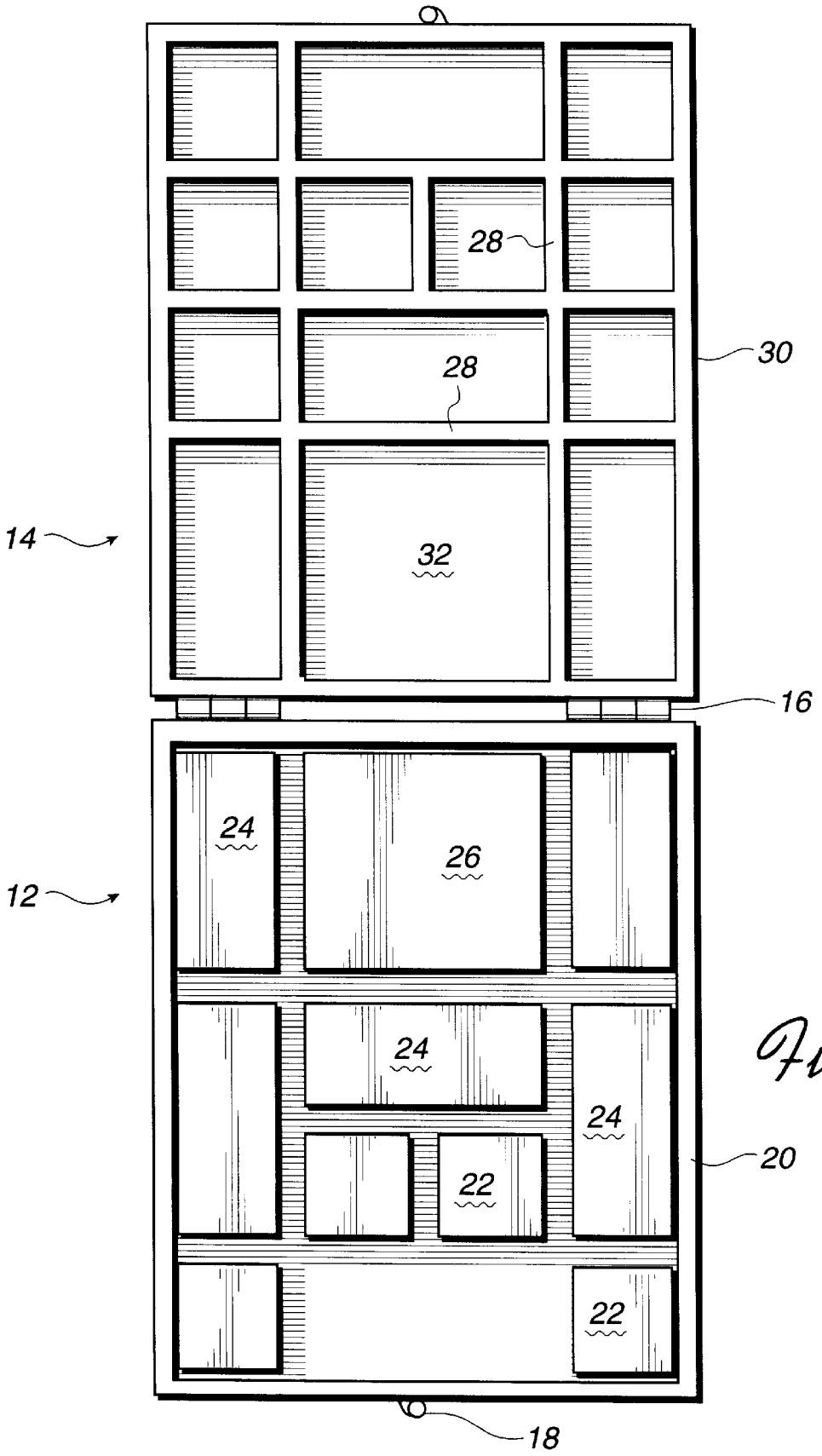
FIG. 1 is a plan view of the opened game box showing the partitions in the lid and blocks in their initial positions on the smooth playing board.

The slidable block puzzle of the invention employs a block maneuvering box with a cover or lid. FIG. 1 is a plan view of the block puzzle maneuvering box 12 with a lid 14 attached at one end by hinges 16. A clamp 18 is centered in the opposite end for locking the lid 14 when the box is closed.

The puzzle is played in the maneuvering box 12 which has a smooth floor surrounded by low walls 20 about ⅛ inch in height. It is played with ten blocks of various sizes, each about 3/16 inches in thickness. The ten puzzle blocks include four small square blocks 22 which, in the preferred embodiment, are one inch square; five one rectangular blocks 24 are one inch by two inches and one large square block 26 that is two inches square. The ten blocks are initially placed on the floor the maneuvering box 12 in the order illustrated in FIG. 1 and the puzzle is solved when the larger block 26 has been maneuvered to the center of the opposite end of the box 12.

To facilitate the proper placement of the ten blocks in the floor the maneuvering box 12 and also to assure the separation of the blocks while the lid is closed, each of the ten blocks are placed areas in the lid 14 bordered by partitions 28. The partitions 28 and a wall 30 around the floor of the lid 14 are ⅛ inch in height in the preferred embodiment. The partitions 28 are spaced in the lid according to the initial placement of the ten blocks and they are spaced from each other to be slightly more than the dimension of the block to permit easy placement of the block between partitions without binding. Thus large block 26 on the floor of maneuvering box 12 would easily fit into the area 32 in the lid 14 without stick or binding to the partition 28.

FIG. 2 is a plan view of the slidable block puzzle game with the lid 14 closed.

FIG. 3 is a sectional edge view taken along the lines 3—3 of FIG. 2 showing the maneuvering box 12 inverted with the partitioned lid 14 on the bottom. The maneuvering box 12 has ⅛ inch high walls 20 and partitioned lid 14 has ⅛ inch high partitions 28 and walls 30. The thickness of the ten blocks, such as the blocks 22, must be more than ⅛ inch so that then will remain in place while the lid is closed and must not exceed ¼ inch so that the lid will close.

The puzzle is started by inverting the puzzle from its position in FIG. 3 so that the maneuvering box 12 is on the bottom, and opening the lid 14 so observe the ten blocks 22, 24, 26 in their initial order as shown in FIG. 1.

FIG. 4(*a*) through (*w*) disclose the block moves for one method of solving the slidable block puzzle. The puzzle requires four small square blocks, one large block and five rectangular blocks in a maneuvering area large enough for six rectangular blocks. Therefore, there is always an open or empty space the size of one rectangular block or two small square blocks. In FIG. 4 the individual blocks are arbitrarily numbered from 1 to 10 and the absence of a number represents an empty space. FIG. 4(*a*) represents the blocks in their initial order as arranged by the lid 14.

FIG. 4(*b*) is obtained by sliding the blocks 9 and 10 into the empty space and lowering blocks 4 and 6. FIG. 4(*c*) is obtained by sliding block 5 toward the left. Move blocks 8 and 10 into the empty space and slide block 6 toward the left to get FIG. 4(*d*). Drop blocks 8 and 10 into the empty space and slide block 5 to the right to get FIG. 4(*e*). FIG. 4(*f*) shows that blocks 7 and 9 have been moved into the empty space. And block 6 has taken their places, and blocks 8 and 10 have been moved down in FIG. 4(*g*). In FIG. 4(*h*) block 5 has been dropped down over 8 and 10 and blocks 7 and 9 have been moved over 5. Moving up blocks 4 and 6 and sliding blocks 8 and 10 to the left produces FIG. 4(*i*).

FIG. 4(*j*) is produced by dropping block 5 into the empty space and then moving block 7 down and under block 9. Moving block 6 to the right, moving blocks 8 and 10 into the empty space and then sliding block 5 to the left produces FIG. 4(*k*). Move blocks 7 and 9 down into the apace formerly occupied by block 5 as shown in FIG. 4(*l*). Then move the entire center row including blocks 4, 8, 10 and 6 to the right to produce FIG. 4(*m*). FIG. 4(*n*) shows that Block 1 is moved down, block 2 is moved to the left to fill the space left by block 1, blocks 8 and 10 are moved upward, and blocks 7 and 9 are moved in the spaces left by 8 and 10.

Moving block 5 to the right, dropping blocks I and 4 into the empty space, lowering block 2, moving blocks 8 and 10 into the spaces over block 2 and moving up block 7 generates FIG. 4(*o*). Moving block 2 to the right, sliding up block 1, moving block 4 to the left, sliding block 9 to the left and down into the space between 4 and 5, and finally lowering block 2 produces FIG. 4(*p*). Dropping block 7 and moving it left, then moving block 3 to the left and raising block 6 into the space formerly occupied by block 3, and moving block 2 to the right gives FIG. 4(*q*) FIG. 4(*r*) results by rotating clockwise the two left columns of blocks.

FIG. 4(*s*) is obtained by moving block 2 to the left, dropping block 6, sliding the first row of blocks to the right the finally raising block 4 into the first row. Move block 2 to the left and FIG. 4(*t*) results. Now, move blocks 8 and 10 down into the empty space, move block 3 to the left to fill the void, move block 6 up to replace block 3, slide block 8 to the right and raise block 5 and FIG. 4(*u*) results. FIG. 4(*v*) is produced by moving blocks 7 and 9 into the empty space, lowering block 2 into the bottom row, moving blocks 8 and 10 to the left and sliding block 5 up to replace 8 and 10. Finally, raise block 7 and slide in block 9 under it and move block 2 to the right and into a final position shown in FIG. 4(*w*).

I claim:

1. A slidable block puzzle game wherein a plurality of blocks of various sizes and shapes are maneuvered within a confined area in order to move one object block from an initial position to a target position, said block puzzle comprising:

a plurality of ten blocks, all of said blocks being of equal thickness and having rectangular shapes, four of said blocks being small squares having a dimension of one unit square, five of said blocks having dimensions of one unit by two units, and one object block having a dimension of two units square;

a maneuvering box having a smooth inside surface surrounded by low side walls, said inside surface having a dimension substantially equal to five units long and four units wide;

a lid for said maneuvering box, said lid having an interior surface dimension substantially identical to that of said maneuvering box, said lid interior surface surrounded by low walls and having a plurality of raised partitions, the spaces between said partitions loosely fitting each of said plurality of ten blocks in a predetermined order.

2. The slidable block puzzle game claimed in claim 1 further including hinge means attached to said maneuvering box and said lid for coupling said lid to said maneuvering box.

3. The slidable block puzzle game claimed in claim 2 wherein the thickness of said blocks is greater then the height of said walls and partitions in said lid and is less than the height of said walls in said maneuvering box plus the height of said walls in said lid.

4. The slidable block puzzle game claimed in claim 2 further including clasp means attached to said lid and to maneuvering box for locking said box and said lid together.

* * * * *

UNITED STATES PATENT AND TRADEMARK OFFICE

CERTIFICATE OF CORRECTION

PATENT NO. : 6,116,600
DATED : Sep. 12, 2000
INVENTOR(S) : Labib A. Aryan

It is certified that error appears in the above-identified patent and that said Letters Patent is hereby corrected as shown below:

In the Drawing:

Delete Figure 1, and insert the following figure, showing Figure 1, as per attached page.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO : 6,116,600

DATED : Sep. 12, 2000

INVENTOR(S) : Labib A. Aryan

It is certified that error appears in the above-identified patent and that said Letters Patent are hereby corrected as shown below:

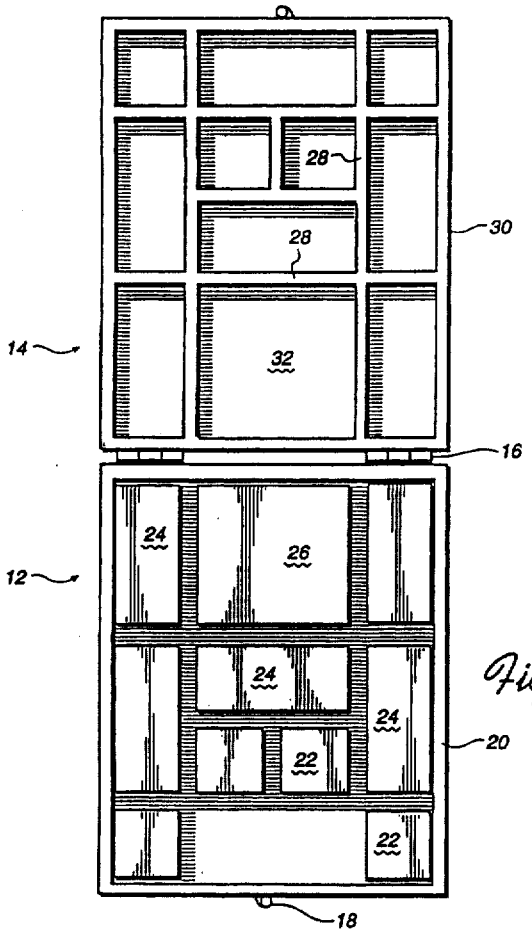

Fig. 1